United States Patent [19]

Osmonson et al.

[11] Patent Number: 4,926,892

[45] Date of Patent: May 22, 1990

[54] TEMPORARY ENCLOSURE STRUCTURE

[75] Inventors: Daniel T. Osmonson, Fountain Hills, Ariz.; James L. McNulty, North Vernon, Ind.

[73] Assignee: Krohm, Inc., Columbus, Ind.

[21] Appl. No.: 436,593

[22] Filed: Nov. 15, 1989

[51] Int. Cl.[5] ..... E04H 15/38

[52] U.S. Cl. ..... 135/103; 135/DIG. 9; 135/112; 135/900; 135/109

[58] Field of Search ..... 135/87, 101, 103, 900, 135/112, DIG. 9, 902, 107; 182/152, 183

[56] References Cited

U.S. PATENT DOCUMENTS

| | | | |
|---|---|---|---|
| 2,886,047 | 5/1959 | Healy | 135/87 X |
| 2,916,102 | 12/1959 | Reinhardt | 182/152 |
| 3,913,598 | 10/1975 | Glutting, Jr. et al. | 135/87 X |
| 4,702,478 | 10/1987 | Kruse | 135/101 X |
| 4,703,769 | 11/1987 | Harrison, Jr. | 135/DIG. 9 |
| 4,774,792 | 10/1988 | Ballance | 52/282 |

FOREIGN PATENT DOCUMENTS

| | | | |
|---|---|---|---|
| 2129464 | 5/1984 | United Kingdom | 135/103 |

*Primary Examiner*—David A. Scherbel
*Assistant Examiner*—Lan Mai
*Attorney, Agent, or Firm*—Woodard, Emhardt, Naughton, Moriarty & McNett

[57] ABSTRACT

One embodiment of a temporary enclosure structure includes a rear frame section and a pair of side frame sections. The rear frame section includes a pair of spaced apart tubular vertical support members and a pair of extensible tubular horizontal members attached between the vertical support members to define a generally planar frame. Each of the side frame sections includes a pair of extensible vertical members and a pair of extensible horizontal members connected therebetween to also define a generally planar frame. Each vertical support member of the rear frame section includes a pair of spaced apart frame supports for supporting each of the side frame sections and against which the extensible horizontal members rests. Each frame support includes a rear pipe section concentrically disposed about a vertical support and a removable fastener for connecting the rear pipe section thereto. A forward pipe section, integral with the rear pipe section, is concentrically disposed about an extensible vertical member of the side frame section and is adapted to permit extension of the side frame vertical member. A second embodiment of the temporary enclosure structure includes a rear frame section and a side frame section similar to the first embodiment. The second embodiment includes an upper frame section including a pair of nested extensible tubes, each mounted to opposite vertical members of the side frame section. The temporary enclosure structure of the second embodiment is particularly adapted for use with vaulted or cathedral ceilings.

10 Claims, 2 Drawing Sheets

TEMPORARY ENCLOSURE STRUCTURE

BACKGROUND OF THE INVENTION

The present invention relates to temporary enclosure, barrier or partition structures. In particular, the invention concerns extensible support frames or structures for providing temporary or semi-permanent enclosures or barriers at a workplace or similar site.

There are many applications for so-called portable enclosures, barriers or partitions. For instance, a portable screen can be used to partition off a particular workplace. One such application concerns painting or carpentry work in an existing building in which it is desirable to prevent debris from leaving the work area and infiltrating other areas of the building. Another application is in the patching of ceilings in which spackling paste or drywall repair materials are airborn within the work area. A temporary barrier or screen around the work area is important to keep the airborn debris from entering the relatively clean areas adjacent the workplace.

These temporary enclosures can have a variety of uses, inside or outside a building. For instance, temporary enclosures can provide some measure of insulation or protection from the elements when used as a duck blind or even as an ice fishing enclosure. The temporary enclosure structure can also be used for storage, such as for storing wood, or housing automobiles.

Temporary enclosure structures of this sort must be portable and easily assembled into a variety of arrangements to accommodate a particular application. The structure must be capable of supporting a shield, such as a tarpaulin or screen. It is preferable that the structure be easily extensible, both vertically and horizontally, in order to cover a wide range of volumes and areas.

It is therefore an object of the present invention to provide a temporary extensible structure that can be used in a variety of applications where a temporary enclosure, barrier, screen, partition, or similar structure is desired.

DESCRIPTION OF THE PREFERRED EMBODIMENTS

Figure 1:
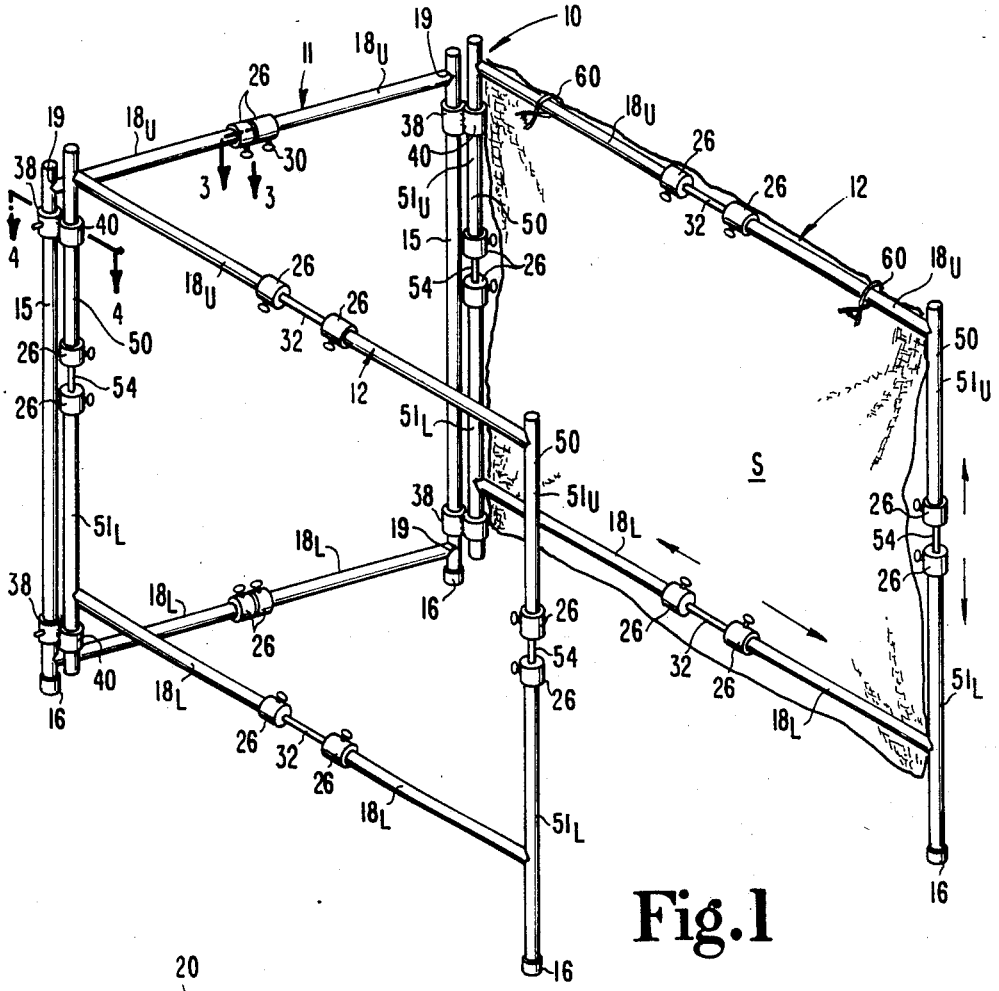
FIG. 1 is a perspective view of the temporary enclosure structure of the present invention.

For the purposes of promoting and understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring first to FIG. 1, one preferred embodiment of the present invention is illustrated in which a temporary enclosure structure 10 is shown. The temporary structure 10 includes a rear frame section 11 and a pair of side frame sections 12. Each of the rear frame section 11 and side frame sections 12 is substantially of tubular construction, preferably composed of 18 gage aluminum tubing so that the entire temporary enclosure structure 10 is lightweight and relatively portable.

The rear frame section 11 includes a pair of vertical tubular support members 15, or tubes, each having a tip or cap 16 mounted at the bottom end of the tubes. The tips 16 may be composed of rubber or plastic or a similar non-scuffing material that is adapted to provide a firm friction grip with the floor of the workplace. The tip 16 may also have a wide base area to provide a solid footing if the temporary enclosure structure 10 is to be used outdoors. A similar tip 16 may be included at the top end of the tubes depending upon the particular application of the temporary enclosure structure 10, for instance if the vertical support tubes are to be abutted against a ceiling. Each of the vertical support tubes 15 is preferably a hollow aluminum tube of 72 inch or 100 inch length having an outer diameter of 0.75 inches.

The rear frame section 11 further includes two sets of horizontal tubular members $\mathbf{18}_U$ and $\mathbf{18}_L$. One end of each of the horizontal tubular members, or tubes, $\mathbf{18}_U$ is affixed at the upper portion of the vertical support tubes 15, while one end of each of the horizontal tubes $\mathbf{18}_L$ is likewise engaged at the lower portion of the vertical tubes. Each of the horizontal tubes 18 is engaged to a corresponding rear frame vertical tube 15 at a connection 19, shown in detail in FIG. 2. A horizontal tube, such as tube $\mathbf{18}_U$ in FIG. 2, includes a beveled portion 24 which is adapted to engage about the vertical tube 15 to hold the horizontal tube in position. A tubing connector 20 is used to attach a horizontal tube, such as tube $\mathbf{18}_u$ to the vertical tube 15. Tubing connector 20 includes a press-fit insert 21 and a threaded screw 22. The threaded screw 22 passes through a bore 23 in the vertical tube 15 and is threaded into collar 21*a* of the press-fit insert. In constructing the tubing connector, the press-fit insert 21 is pressed into the open end of the horizontal tube $\mathbf{18}_U$. Once the horizontal tube is properly aligned adjacent the bore 23 in the vertical tube 15, the screw 22 is passed through the bore and threaded into the press-fit insert, and tightened until the horizontal tube is firmly attached.

Figure 3:
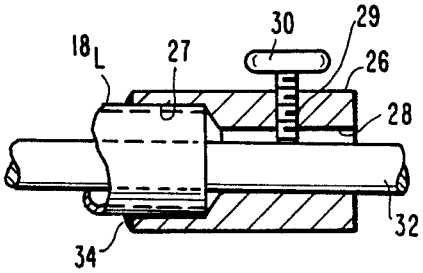
FIG. 3 is an enlarged partial cross-sectional view taken along line 3—3 in FIG. 1 as viewed in the direction of the arrows.

In the preferred embodiment, each of the horizontal tubes $\mathbf{18}_U$ and $\mathbf{18}_L$ is about 30 inches long as measured from the connection 19 of each tube. At the other end of the horizontal tubes $\mathbf{18}_U$ and $\mathbf{18}_L$, that is the interior end of each tube, is a tubing collar 26. The tubing collar is preferably brazed to the interior end to the tubes. The tubing collar 26, shown in more detail in FIG. 3, includes a first interior bore 27 which has an inner diameter approximately equal to the outer diameter of the horizontal tubes, such as horizontal tube $18_L$. The bore 27 necks down to a smaller bore 28 at the other end of the tubing collar. Centered relative to the smaller bore 28 and extending radially therefrom is a threaded bore 29 which is adapted to engage a thumb screw 30.

Extending through the tubing collar and through the hollow center of the horizontal tube $18_L$ is an expansion rod 32. The expansion rod 32 has an outer diameter less than the inner diameter of the smaller bore 28 of the tubing collar 26. In constructing the frame sections, the horizontal tube $18_L$ is inserted into the larger bore 27 of the tubing collar 26. The fit between the horizontal tube and the bore 27 may be a press-fit; however, the collar is preferably brazed to the horizontal tube at location 34 around the circumference of the horizontal tube, to permanently affix the collar to the inner end of the horizontal tube $18_L$. The expansion rod 32 is then inserted through the open end of the tubing collar and into the interior of the hollow horizontal tube $18_L$. The thumb screw 30 is threaded into the threaded bore 29 until the end of the thumb screw contacts and presses against the expansion rod 32. In this manner, the expansion rod 32 can be, in effect, clamped within the tubing collar 26.

As shown in FIG. 1, an expansion rod 32 is fully contained within both upper horizontal tubes $18_U$ and both lower horizontal tubes $18_L$ of the rear frame section 11. The expansion rods 32 permit separation of the respective horizontal tubes 18 with the expansion rod 32 forming a bridge between the tubing collars 26 of the horizontal tubes. This aspect is shown particularly with respect to the side frame sections 12. Each of the side frame sections 12 includes upper and lower horizontal tubes $18_U$ and $18_L$, tubing collars 26 and expansion rods 32 that are identical in construction to the like components for the rear frame section 11. In the preferred embodiment, the expansion rod 32 has a length nearly equal to the total length of two horizontal tubes $18_L$ and $18_U$. Thus, each of the frame sections 11 and 12 can be expanded laterally to a length approximately twice as long as their unextended length with the expansion rod spanning therebetween.

For instance, in the preferred embodiment each of the horizontal tubes 18 has a length of 30 inches and the expansion rod 32 has a length of 60 inches. When the tubing collars 26 of the horizontal tubes $18_U$ of one side frame section 12, for example, are abutting, the expansion rod 32 is fully contained within each of two horizontal tubes. When the side frame section 12 is expanded forward, thereby extending the length of the side frame section, the thumb screw 30 is released from the forwardmost tubing collar 26 and the corresponding horizontal tube is moved or slid over the expansion rod 32 until desired lateral extension has been achieved. A maximum extended length of about 90 inches (30 inches apiece for each horizontal tube and 30 inches for the exposed portion of the rod between the collars 26) can be achieved in this manner. To obtain a greater extension, the thumb screw for the rearmost tubing collar is released to permit the expansion rod to be fully extended from the tube so that the exposed length of the rod is approximately 60 inches (which when combined to the 60 total inches of length of the horizontal tubes provides an extension of 120 inches). The thumb screws 30 can then be threaded into the bore 29 to engage and clamp the expansion rod 32 in position relative to both tubing collars 26.

Figure 4:
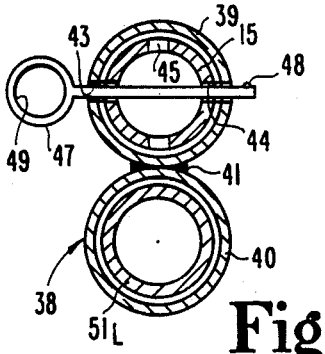
FIG. 4 is an enlarged partial cross-sectional view taken along line 4—4 in FIG. 1 as viewed in the direction of the arrows.

Returning to FIG. 1, in one aspect of the invention, a pair of frame supports 38 are engaged about each of the rear frame section vertical support tubes 15. The details of the frame support 38 are shown more clearly in FIG. 4. The frame support 38 includes a pair of pipe sections, the first being a rear pipe section 39 which is concentrically disposed about the vertical tube 15 of the rear frame section 11. The second portion of frame support 38 is a forward pipe section 40 through which one of the vertical tubes of the side frame section 12 is concentrically disposed. These pipe sections 39 and 40 are preferably joined at a fillet weld 41 to form an integral piece.

The rear pipe section 39 includes a transverse bore 43 through the pipe section which aligns with a similar bore 44 in the vertical tube 15. A second bore 45 is provided through the vertical tube 15 at 90° to the first bore 44. The second bore 45 is provided so that the frame support 38 can be rotated relative to the vertical tube 15 of the rear frame section 11, for reasons described more fully herein. A quick release pin 47 extends through the transverse bore 43 of the rear pipe section 39 and the first bore 44 of the vertical tube 15 to support the frame support 38 relative to the vertical tube 15. The quick release pin 47 in the preferred embodiment includes a depressible ball 48 at its end which is adapted to keep the quick release pin 47 in position through the bores 43 and 44. When it is desired to remove the quick release pin, the user can insert a finger through the finger loop 49 and pull the pin from the bores 43 and 44. The compressible ball 48 will be depressed into the pin 47 as it passes through the bores 43 and 44 to allow the pin 47 to be removed.

Referring again to FIG. 1, the side frame sections 12 are further described. Each of the side frame sections include split vertical tube members or sections 50 which define the lateral edges of the side frame sections 12. Each of the split vertical tube sections 50 includes upper and lower vertical tubes $51_U$ and $51_L$. At the interior ends of each of these vertical tubes is a tubing collar 26, affixed in the manner previously described. A second expansion rod 54 is disposed within each of the vertical tubes $51_U$ and $51_L$ in a manner similar to the expansion rod 32. The lower vertical tubes $51_L$ *of the side frame sections* 12 *are similar in construction to the horizontal tubes* $18_U$ or $18_L$, except that these vertical tubes $51_L$ include a tip 16 mounted at their ends. In the embodiment illustrated in FIG. 1, only the freestanding vertical tubes at the forward edge of each of the side frame sections 12 includes a tip 16. The bottom of the vertical tubes $51_L$ immediately adjacent the rear frame section 11 do not require tips 16, although the tips may be included.

Figure 2:
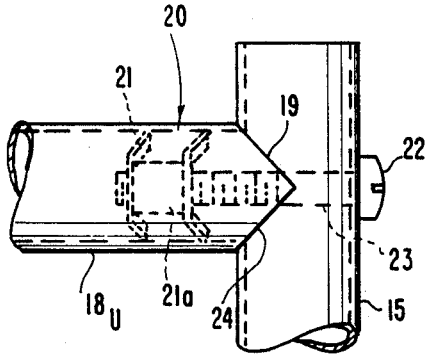
FIG. 2 is an enlarged side elevational view of the connection between a horizontal tubular member and a vertical tubular member of the structure shown in FIG. 1.

In the preferred embodiment, the lower horizontal tubular members or tubes $18_L$ of each of the side frame sections 12 are attached to the vertical tubes $41_L$ of the side frame sections as shown in FIG. 2 and as previously described. Also in the preferred embodiment, the horizontal tubes $18_U$ and $18_L$ for each of the side frame sections rest against the top of the forward pipe section 40 of the frame supports 38. It should be noted, however, that the horizontal tubes $18_L$ and $18_U$ are shown displaced from the forward pipe sections 40 for clarity. It is understood that there is no fixed connection between the vertical tube $51_L$ and the forward pipe section 40, as shown more clearly in FIG. 4, so that the vertical tube is freely rotatable and slidable within the frame support 38.

The upper vertical tubes $51_U$ of the split vertical tube sections 50 of the side frame sections 12 are also slidingly engaged within a forward pipe section 40 of a frame support 38 at the upper end of the rear frame section 11. Thus, the upper vertical tubes $51_L$ can be moved vertically upward by simply releasing the thumb screw 30 of the tubing collars 26 to permit the upper vertical $51_L$ to slide relative to the second expansion rod 54. In FIG. 1, the upper and lower vertical tubes $51_U$ and $51_L$ are shown displaced slightly with the second expansion rod 54 providing the connection therebetween. The expansion rod 54 is clamped within tubing collars 26 at the interior ends of the upper and lower vertical tubes $51_U$ and $51_L$. The vertical tubes $51_U$ and $51_L$ of the split vertical tube sections 50 of each of the side frame sections 12 can have the same length as the horizontal tubes $18_U$ and $18_L$, or these tubes can be longer to provide additional vertical height extension capabilities for the temporary enclosure structure 10.

The temporary enclosure structure 10 is shown in FIG. 1 in its freestanding assembled configuration. In this arrangement, the horizontal tubes $18_U$ and $18_L$ of the side frame sections 12 have been extended to provide greater side exposure. The vertical tubes $51_U$ and $51_L$ of the side frame sections 12 have also been separated to provide greater height or vertical coverage for the temporary enclosure structure 10. A screen or tarpaulin, such as screen S, can be supported or carried by the frame sections of the temporary enclosure structure 10, as shown in FIG. 1. In one embodiment of the invention, a pair of tube clamps 60 are used to mount the screen S to the horizontal tubes $18_U$ of the side frame section 12. Other types of similar clamps or connectors may be used as required to adapt the temporary enclosure structure 10 to a particular screen or covering.

Figure 5:
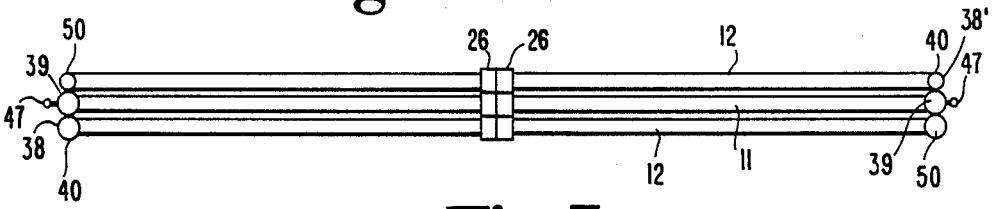
FIG. 5 is a top elevational view of the structure of FIG. 1 shown in its closed configuration.

One advantage of the present invention is shown with reference to FIG. 5. As previously described, the frame supports 38 at either side edge of the rear frame section 11 includes a quick release pin 47 which can be removed to permit relative movement between the frame support 38 and the vertical support tubes 15 of the rear frame section 11. When it is desired to store the temporary enclosure structure 10 of the present invention, the side frame sections 12 are pivoted or rotated within the forward pipe sections 40 of the frame support 38 until they are generally parallel with the rear frame section 11. In order to insure as flat a package as possible for transport or storage, the frame support 38' at the right side of the rear frame section 11 is pivoted from the forward facing position, as depicted in FIG. 1, to the rearward facing position, as shown at the right side of the rear frame section 11 in FIG. 5. When the frame support 38 is rotated to the rearward facing position, the second bore 45 through vertical tubular member 15 of the rear frame section 12 is used to receive the quick release pin 47. In this manner, a flat and compact package is insured, since one of the side frame sections 12 is folded against one face of the rear frame section 11, while the other of the side frame sections 12 is folded against the opposite face of rear frame section 11. Naturally, when the temporary enclosure structure 10 is being stored, the thumb screws 30 are released to permit the horizontal tubes $18_U$ and $18_L$, as well as the split vertical tubes sections 50 of the side frame sections 12, to be pushed together.

Figure 6:
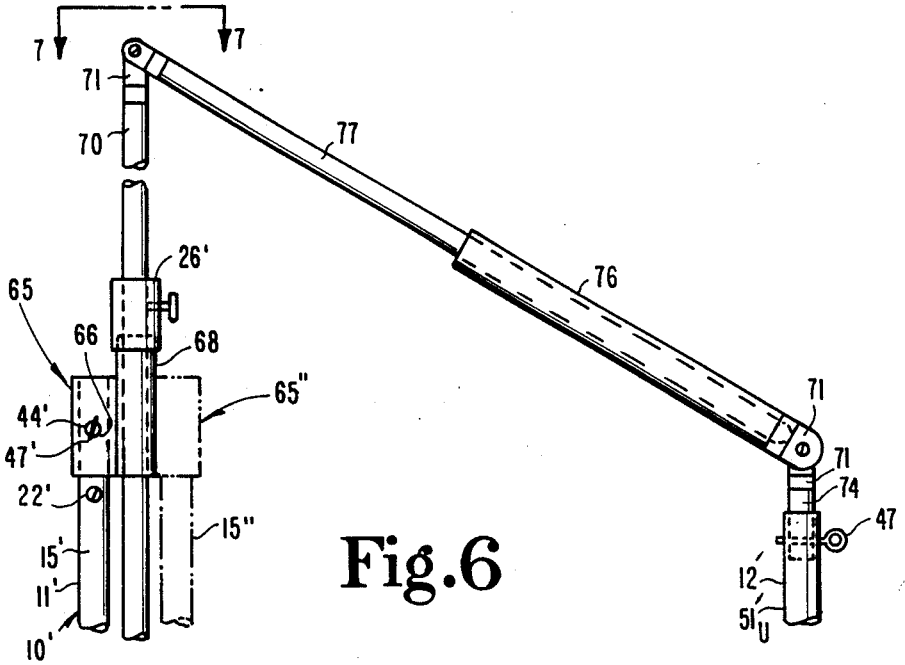
FIG. 6 is a side elevational view of the upper frame section of a second embodiment of the temporary enclosure structure of the present invention.

A second embodiment of the present invention illustrated in FIG. 6 has particular use in accommodating cathedral-type or vaulted-type ceilings. When repair work is performed on a ceiling of this type, the angled or sloped ceiling surface requires a special temporary enclosure structure configuration. In this second embodiment, a rear frame section 11' is similar to the rear frame section 11 previously described. In particular, the rear frame section 11' includes a support body 65 that is mounted on the top of the rear frame vertical support tubular members or tubes 15'. The rear frame vertical support tubes 15' are similar to the rear frame tubes 15 of the previous embodiment with the exception that the bores 44' through the vertical tubes are situated above the screws 22' used to attach the horizontal tubes to the vertical tubes. The side frame sections 12' are modified from the side frame sections 12 previously described in that the horizontal tubes at the top of the side frame section 12' have been replaced by an upper frame section described herein.

In this second embodiment, the support body 65 is mounted over the top end of each of the vertical support tubes 15' of the rear frame section 11' and held in position by a quick release pin 47' which extends through a bore 66 in the support body 65 and the bore 44' through the vertical tube 15'. The support body 65 includes an integral sleeve 68 with a tubing collar 26' brazed to the top end of the sleeve 68. The tubing collar 26 is identical to the tubing collar 26 previously described. The embodiment of FIG. 6 includes a vertical tube 70 which preferably replaces the vertical tube $51_U$ of the previous embodiment. This vertical tube 70, however, is much longer than the vertical tube $51_U$ so that it can accommodate the higher cathedral or vaulted ceilings popular in homes and other buildings today. The free end of the vertical tube 70 is formed into a flange 71, as shown more clearly in FIG. 7.

At the front edge of the side frame section 12',a front support 74 is inserted into the hollow open end of a vertical tube $51_U'$ of the side frame section 12'. A quick release pin 47 extends through bores in the vertical tube $51_U'$ and the front support 74 to attach the front support to the vertical tube. This second embodiment includes a pair of nested extensible tubular members, including an outer extension tube 76, and an inner extension tube 77 which is slidably disposed within the outer extension tube. Each of the extension tubes 76 and 77 is hingedly attached to the respective front support 74 and vertical tube 70 at flanges 71.

Figure 7:
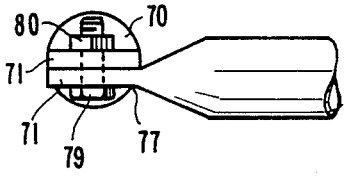
FIG. 7 is a top view of the connection between the inner extension tube and the extensible vertical member of the embodiment of FIG. 6 as viewed in the direction of the arrows.

As shown more clearly in FIG. 7, the flanges 71 of the vertical tube 70 and inner extension tube 77 are connected by way of a threaded screw 79 and nut 80. The screw 79 and nut 80 can be loosened to permit relative rotation between the two flanges 71 of the vertical tube 70 and inner extension tube 77. Thus, when the cathedral temporary enclosure structure 10' of the second embodiment is assembled, the vertical tube 70 can be raised or lowered according to the height of the cathedral or vaulted ceiling to be worked on. The length of the area covered by the temporary enclosure structure 10' can be varied by extending or retracting the inner extension tube 77 relative to the outer extension tube 76. Once the final configuration of the temporary enclosure structure 10' has been achieved, the screw 79 and nut 80 can be tightened at each of the flanges 71 between the outer extension tube 26 and the front support 74, and between the inner extension tube 77 and the vertical tube 70.

Referring again to FIG. 6, an alternative arrangement of the support body is shown in phantom and designated as body 65''. Body 65'' is mounted atop vertical support member 15" and replaces the rearward orientation previously described. In this latter arrangement, support body 65" is simply rotated about the axis of the vertical tube 70, thereby permitting the vertical tube 70 to define the rearmost portion of the temporary enclosure structure 10'. This arrangement permits the enclosure structure 10' to be situated closer to a vertical wall to more completely enclose the work area.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A temporary enclosure structure comprising:

a rear frame section, including;

a pair of spaced apart tubular vertical support members;

a first pair of extensible tubular horizontal members;

means for attaching each of said first pair of extensible horizontal members between said pair of vertical support members in spaced apart relation to define a generally planar frame;

a side frame section, including;

a pair of spaced apart extensible tubular vertical members;

a second pair of extensible tubular horizontal members;

second means for attaching each of said second pair of extensible horizontal members between said pair of extensible vertical members in spaced apart relation to define a generally planar frame; and a pair of frame supports engaged on said rear frame section for supporting said side frame section, each of said pair of frame supports being in vertical spaced apart relation and including;

a rear pipe section concentrically disposed about one of said pair of vertical support members of said rear frame section;

a forward pipe section integral with said rear pipe section, concentrically disposed about one of said pair of extensible vertical members of said side frame section, wherein said one vertical member is slidable within to said forward pipe section; and a removable fastener for connecting said rear pipe section to said one of said pair of vertical support members of said rear frame section.

2. The temporary enclosure structure of claim 1, wherein each of said pair of extensible vertical members and each of said first and second pairs of extensible horizontal members includes:

a first tube;

a first collar affixed to one end of said first tube and having a passageway therethrough;

an expansion rod slidably disposed within said first tube and said passageway of said first collar; and first means, carried by said first collar, for clamping said expansion rod relative to said first collar.

3. The temporary enclosure structure of claim 2, wherein each of said pair of extensible vertical members and each of said first and second pairs of extensible horizontal members further includes:

a second tube opposing said first tube;

a second collar affixed the end of said second tube opposing said first tube, said second collar having a passageway therethrough; and means, carried by said second collar, for clamping said expansion rod relative to said second collar, wherein said expansion rod is slidably disposed within said second tube so that said first and second said tubes are relatively movable along said expansion rod.

4. The temporary enclosure structure of claim 2, wherein:

said collar and said expansion rod of said extensible vertical members of said side frame section are situated vertically between each of said pair of frame supports engaged on said rear frame section.

5. The temporary enclosure structure of claim 1, wherein said removable fastener is a quick release pin.

6. The temporary enclosure structure of claim 1, wherein:

said rear pipe section of each of said pair of frame supports is rotatable about said one of said pair of vertical support members of said rear frame section; and said one of said pair of vertical members of said side frame section is rotatable within said forward pipe section of each of said pair of frame supports;

whereby said side frame section is foldable parallel to and adjacent said rear frame section.

7. The temporary enclosure structure of claim 5, further comprising:

a second side frame section, including;

a second pair of spaced apart extensible tubular vertical members;

a third pair of extensible tubular horizontal members;

third means for attaching each of said third pair of extensible horizontal members between said second pair of extensible vertical members in spaced apart relation to define a generally planar frame; and a second pair of frame supports engaged on said rear frame section for supporting said second side frame section, each of said second pair of frame supports being in vertical spaced apart relation and including;

a second rear pipe section concentrically disposed about the other of said pair of vertical support members of said rear frame section;

a second forward pipe section integral with said second rear pipe section, concentrically disposed about one of said second pair of extensible vertical members of said second side frame section, wherein said one vertical member is slidable within said second forward pipe section; and a second removable fastener for connecting said second rear pipe section to said other of said pair of vertical support members of said rear frame section.

8. The temporary enclosure structure of claim 7, wherein:

said second rear pipe section of each of said second pair of frame supports is rotatable about said other of said pair of vertical support members of said rear frame section; and said one of said second pair of vertical members of said second side frame section is rotatable within said second forward pipe section of each of said second pair of frame supports;

whereby said second side frame section is foldable parallel to said first side frame section and adjacent the opposite face of said rear frame section.

9. A temporary enclosure structure adapted for use with cathedral or vaulted ceilings comprising:

a rear frame section, including;

a pair of spaced apart tubular vertical support members;

a first pair of extensible tubular horizontal members;

means for attaching each of said first pair of extensible horizontal members between said pair of vertical support members in spaced apart relation to define a generally planar frame;

a side frame section, including;

a first tubular vertical member;

a second extensible tubular vertical member spaced apart from said first vertical member;

at least one extensible tubular horizontal member;

second means for attaching said extensible horizontal member between said first and second vertical members at a lower portion of each of said vertical members;

a first frame support engaged on said rear frame section for supporting said side frame section, including;

a rear pipe section concentrically disposed about one of said pair of vertical support members of said rear frame section at a lower portion thereof;

a forward pipe section integral with said rear pipe section, concentrically disposed about and supporting said second extensible vertical member of said side frame section; and a removable fastener for connecting said rear pipe section to said one of said pair of vertical support members of said rear frame section;

a second frame support engaged on said rear frame section for supporting said side frame section, including;

a second rear pipe section concentrically disposed about said one of said pair of vertical support members of said rear frame section at an upper portion thereof;

a sleeve integral with said second rear pipe section, concentrically disposed about said second extensible vertical member of said side frame section, wherein said second extensible vertical member is slidable within said sleeve; and a second removable fastener for connecting said second rear pipe section to said one of said pair of vertical support members of said rear frame section;

an upper frame section including;

a front support connected to an upper portion of said first vertical member of said side frame section;

an outer extension tube;

first means for hingedly connecting one end of said outer extension tube to said front support;

an inner extension tube concentrically disposed within and slidable relative to said outer extension tube; and second means for hingedly connecting one end of said inner extension tube to said second extensible vertical member.

10. The temporary enclosure structure adapted for use with cathedral or vaulted ceilings of claim 9, wherein:

said first means for hingedly connecting includes;

a first flange defined at one end of said second extensible vertical tubular member, said first flange defining a first opening therethrough;

a second flange defined at said one end of said inner extension tube, said second flange defining a second opening therethrough; and a fastener through each of said first and second openings for fastening said first flange to said second flange.

* * * * *